United States Patent [19]

Husges et al.

[11] Patent Number: 4,466,575

[45] **Date of Patent: * Aug. 21, 1984**

[54] DEVICE FOR FORMING A RESERVE WINDING ON A BOBBIN TUBE

[75] Inventors: Gerd Husges, Schwaikheim; Horst Hofer; W. Gerhard Hoeber, both of Ingolstadt, all of Fed. Rep. of Germany

[73] Assignee: Schubert & Salzer, Ingolstadt, Fed. Rep. of Germany

[ * ] Notice: The portion of the term of this patent subsequent to Apr. 21, 2000 has been disclaimed.

[21] Appl. No.: 122,992

[22] Filed: Feb. 20, 1980

[30] Foreign Application Priority Data

Feb. 24, 1979 [DE] Fed. Rep. of Germany ..... 2907296

[51] Int. Cl.[3] ..... B65H 54/02

[52] U.S. Cl. ..... 242/18 PW

[58] Field of Search ..... 242/18 PW, 18 A, 18 DD, 242/19; 57/299

[56] References Cited

U.S. PATENT DOCUMENTS

| | | | |
|---|---|---|---|
| 2,517,625 | 8/1950 | Bauer et al. | 242/18 PW |
| 3,974,972 | 8/1976 | Egli et al. | 242/18 PW |
| 4,154,409 | 5/1979 | Reisser et al. | 242/18 PW |
| 4,158,444 | 6/1979 | Krauss | 242/19 X |
| 4,195,788 | 4/1980 | Miyazaki et al. | 242/18 PW |

*Primary Examiner*—Stanley N. Gilreath

[57] ABSTRACT

The present invention relates to a device for forming a reserve winding on a bobbin tube outside the traversing path of a main thread guide which moves to and fro along the bobbin tube wherein a thread holding device is disposed in the vicinity of a thread path between a thread delivery point and the bobbin tube. The device includes an auxiliary thread guide arranged in the region of the reserve winding between the bobbin tube and the thread holding device having two deflecting guides between which the thread can be guided parallel to the surface of the bobbin tube whereby a thread catching projection disposed on the bobbin tube and rotating therewith projects between the two deflecting guides for catching the thread, and a movable thread guide arranged on the side of the auxiliary guide away from the bobbin for transferring the thread to the main traversing thread guide after the reserve is formed.

14 Claims, 4 Drawing Figures

FIG. 2
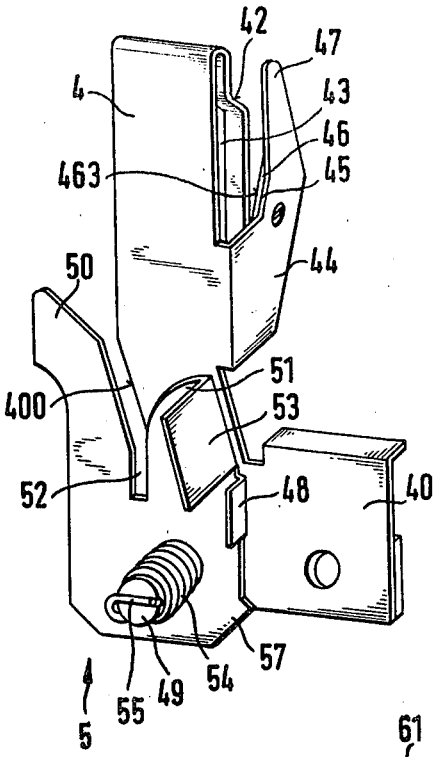
FIG. 3
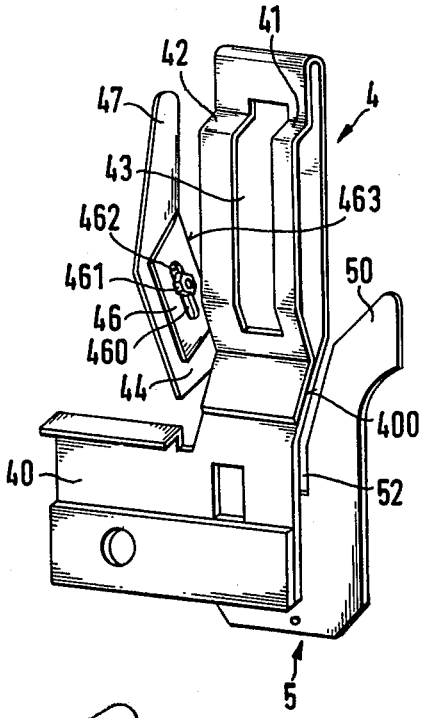
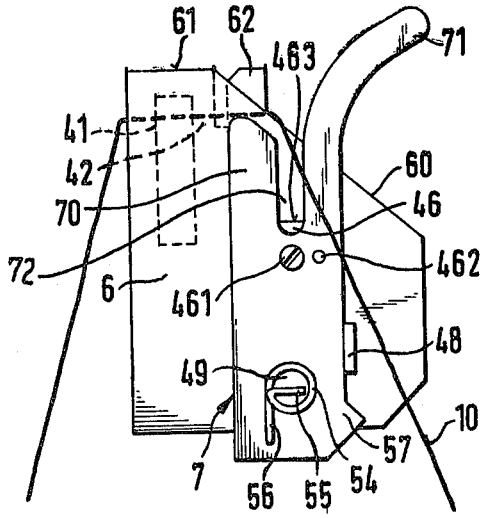
FIG. 4

DEVICE FOR FORMING A RESERVE WINDING ON A BOBBIN TUBE

BACKGROUND OF THE INVENTION

Prior reserve forming devices have included an auxiliary thread guide disposed pivotably in front of the rotating bobbin tube (German Auslegeschrift No. 2 543 986, FIG. 1). In this case, formation of the reserve windings is claimed to be ended by pivoting of the auxiliary thread guide in the direction of the center of the tube. The auxiliary thread guide must be located close to the bobbin tube so that the thread catching projection provided on the bobbin tube can receive the thread from the auxiliary thread guide. There is a risk, on pivoting of the auxiliary thread guide, of the guide coming into contact with the thread catching projection which leads to damage to these parts.

To avoid this disadvantage, the method has been proposed of arranging the thread guide in front of the bobbin tube in such a way that it is not moved parallel to the surface of the bobbin tube (German Auslegeschrift No. 2 616 965). The thread reserve is formed from the thread extending from a yarn delivery point to the thread guide. Due to its tension the thread travels in the direction of the center of the tube until the traversing thread guide receives it and forms regular windings. Control of the length of the thread reserve is hence not possible.

SUMMARY OF THE INVENTION

Accordingly, an important object of the present invention is to provide a device of simple construction which renders possible reliable transfer of a thread to a bobbin tube and control of the length of the thread reserve without the risk of a collision between moving parts thereof.

This object is achieved according to the invention by an auxiliary thread guide having deflecting guides rigidly connected to a support and a movable thread guide carried by the auxiliary guide on a side thereof facing away from the bobbin tube which can be moved into the path of the traversing main thread guide. The auxiliary thread guide places the thread in front of the thread catching projection of the bobbin tube. Since this auxiliary thread guide is rigidly connected to its support, it does not perform any movements either and therefore also cannot move into the region of the rotating thread catching projection. Movement to control the number of reserve windings is carried out by the movable thread guide which is associated with the auxiliary thread guide. The thread is guided between fork-like ends of the movable thread guide and passes on movement of the thread guide into the region of the traversing main thread guide which takes the thread and forms the regular windings.

In an advantageous embodiment of the invention, the movable thread guide is loaded by a spring by which the thread guide is held in its starting position in the region of the reserve winding in abutment with a stationary stop. By this means, it is only necessary to move the thread guide into the thread release position while the thread guide automatically returns to its starting position.

Preferably, the movable thread guide is mounted pivotably and includes a second arm which cooperates with the stop which sets the starting position of the thread guide to limit pivotal movement of the thread guide.

For simple actuation of the movable thread guide, one of the fork-like ends includes on a side facing away from the main thread guide an actuating member extending perpendicularly to the plane of movement. By so arranging the actuating member, the actuating member never cross the thread path on movement of the thread guide into the thread release position so that no interruptions and difficulties occur.

The deflecting guides of the auxiliary thread guide may be constructed fundamentally in different ways. According to a preferred embodiment, which is particularly easy to manufacture, the deflecting guides are constructed as two shoulders of the auxiliary thread guide separated from each other by a slot which faces towards the bobbin tube. The support of the auxiliary thread guide, according to the invention carries the movable thread guide.

In order to limit the width of the reserve winding to a short length of the bobbin tube, according to a further aspect of the invention, the auxiliary thread guide tapers on a side facing the main thread guide and on an end facing away from the deflecting guides, wherein a slot between the fork-like ends of the movable thread guide is located in the region of this taper.

In order to avoid a separate operation for severing the thread held between the auxiliary thread guide and thread holding device when the reserve winding is formed from thread extending from the thread delivery point, the auxiliary thread guide comprises an arm extending in the direction of the bobbin tube between the deflection guides and the thread holding device having a groove in which an exchangeable blade is disposed. When the rotating thread catching projection on the bobbin takes over the thread from the auxiliary thread guide, it draws the thread down into this groove onto the blade which severs the thread. In order to insure that the thread does not jump over the arm, the arm is angled and includes a section which runs essentially parallel to the auxiliary thread guide and extends beyond the deflecting guides.

In another embodiment of the invention in which the reserve winding is formed from the thread extending to the thread holding device, the auxiliary thread guide comprises an approach ramp between the deflecting guides and the thread holding device. The front of one of the forked ends of the movable thread guide facing towards the thread holding device extends beyond the ramp, while the front of the other forked end facing away from the thread holding device ends below the approach ramp. In order to avoid running of the reserve winding to the end of the bobbin and hence the creation of a wide reserve winding, a stationary thread guide is provided next to the deflecting guide facing towards the thread holding device adjacent the approach ramp. In this way, narrow thread reserves are made possible, whereby an economical thread length is taken off from the thread holding device. Automatic severing of the thread extending to the thread holding device is provided by an exchangeable blade between the two prongs of the fork ends. On movement of the thread guide, the longer side of the forked end lifts the thread via the approach ramp toward the tube center whereat the thread passes against the blade between the two prongs and is severed due to the thread tension.

Regardless from which thread section the reserve winding is formed, the blade is adjustable parallel to its cutting edge according to a further aspect of the invention. Since generally the thread always moves toward the same abutment point with the blade, the blade may be adjusted such that a different section of the cutting edge effects the cutting operation. In this way the durability of the blade can be substantially increased and its cutting edge better utilized.

According to a preferred embodiment of the invention, the auxiliary thread guide is constructed as a bent stamped sheet metal part with the deflecting guides formed by shoulders of the sheet metal.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein, an example of the invention is shown and wherein:

FIG. 2 is a perspective view illustrating a device for forming a reserve winding on a bobbin according to the invention, FIG. 3 is a perspective view from the reverse side of the device illustrated in FIG. 2, and FIG. 4 is an elevation illustration an alternate embodiment of a device for forming a reserve winding on a bobbin according to the invention.

DESCRIPTION OF A PREFERRED EMBODIMENT

Figure 1:
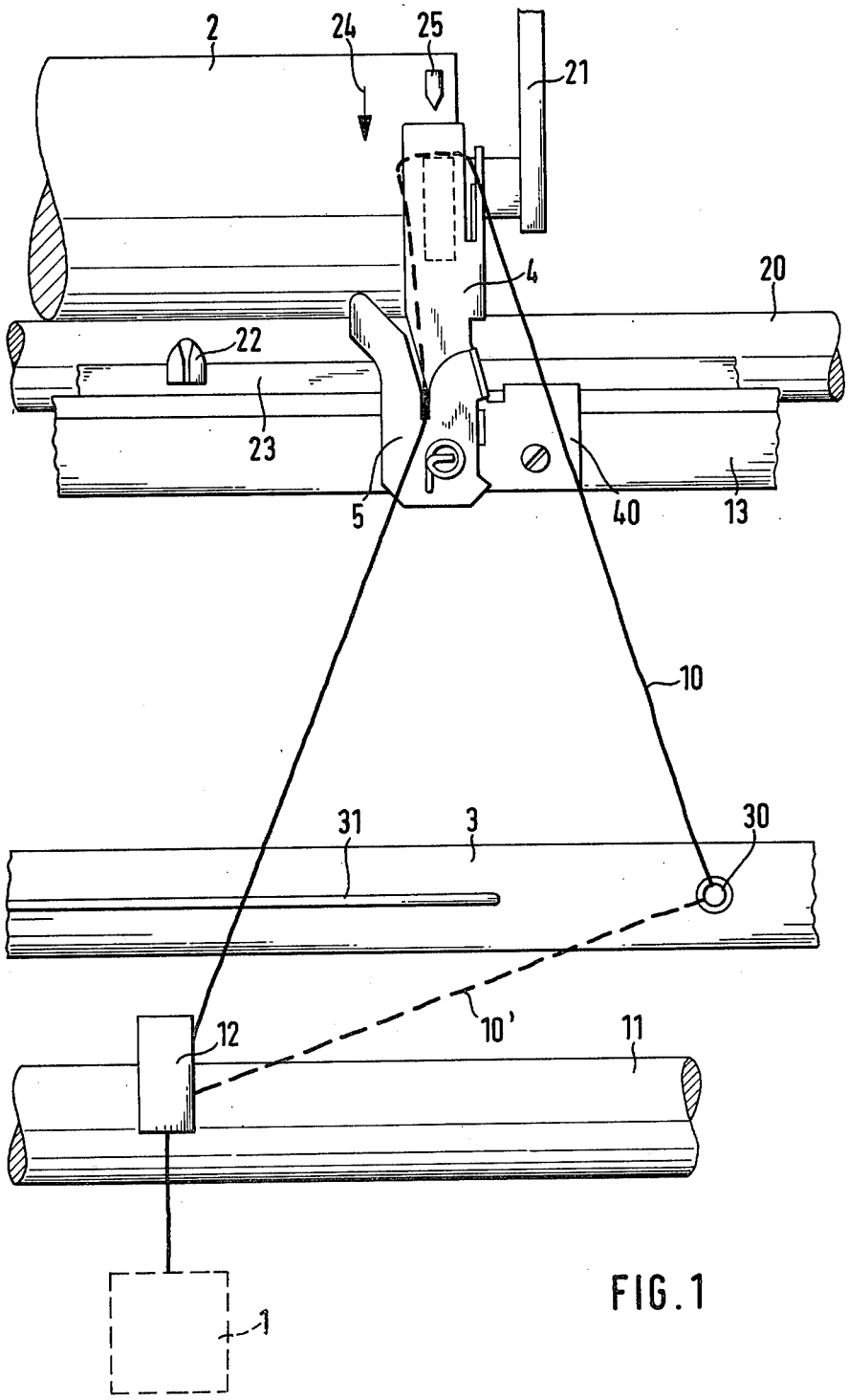
FIG. 1 is an elevation illustrating a spinning station of an open-end spinning machine incorporating a device for forming a thread reserve on a bobbin according to the invention.

The subject of the invention has application to various textile machines, for example to a winding machine or an open-end spinning machine. For the purposes of illustration herein, reference is made below to an open-end spinning machine.

According to FIG. 1, a thread 10 formed by the spinning chamber in an open-end spinning machine and delivered from a thread delivery point 1, is continuously taken off by take-off rollers 11, 12 and wound onto a bobbin tube 2 which, in the working position shown, is driven by frictional entrainment with a drive shaft 20. The bobbin tube 2 is fixed resiliently between two bobbin holding arms 21 which are pivotable about an axis (not shown). In front of the drive shaft 20 is disposed a main thread guide 22 which is mounted on a traversing rod 23 along which it moves to and fro in front of bobbin tube 2.

Between the take-off rollers 11, 12 and the drive shaft 20 is mounted a suction channel 3 with a thread holding device 30 disposed in the vicinity of the thread path which is constructed as a suction air nozzle in the embodiment shown. Further mounted on the suction channel 3 is a thread tension equalizing frame 31.

An auxiliary thread guide 4 for formation of the thread reserve is rigidly connected to a support 40 which, in turn, is attached to the machine frame 13 stationarily.

As illustrated, auxiliary thread guide 4 is seated outside the traversing path of reciprocatable main thread guide 22 and includes two deflecting guides 41 and 42 at its end facing towards the bobbin tube which may be constructed in a fork shape. According to the example shown, however, these deflecting guides are constructed as two shoulders of the auxiliary thread guide 4 separated from each other by a slot 43 facing towards the bobbin tube 2.

The deflecting guides 41 and 42 are located in a plane parallel to the surface of the bobbin tube 2. On the circumferential line between the deflecting guides 41 and 42, the bobbin tube 2 includes a thread catching projecting 25 oriented in the circumferential direction. Disposed between the deflecting guides 41 and 42 and thread holding device 30, auxiliary thread guide 4 has an arm 44 which extends in the direction of the bobbin tube 2 in the vicinity of the thread path of thread 10 as extended from the auxiliary thread guide 4 to the thread holding device 30. The arm 44 extends as far as the side of the thread path opposite the deflecting guides 41 and 42. In a groove 45 of the arm 44 is disposed an exchangeable blade 46.

The arm 44 is angled in the embodiment shown and comprises a section 47 which runs essentially parallel to the auxiliary thread guide 4 and as a length that extends beyond the deflecting guides 41 and 42. Section 47 is located laterally adjacent to the bobbin tube 2, so that sufficient space is available for arm 44.

On the support 40 of the auxiliary thread guide 4 is a movable thread guide 5 pivotably mounted by pin 49 which has a forked free end with two prongs 50 and 51 which are movable into the path of the traversing main thread guide 22. The prong 50 faces towards the main thread guide 22 and serves to thread the thread 10 in a slot 52 between the two prongs 50 and 51. The prong 51 serves to supply the thread 10 to the region of the traversing main thread guide 22. An actuating member 53 is carried by movable thread guide 5 on its side facing away from the main thread guide 22. Actuating member 53 extends perpendicularly to the plane of movement of the thread guide 5 and pivots thread guide 5. Pivoting can be carried out by the operator, or from a device such as an automatic bobbin change-over device (not shown).

In order not to have to return the thread guide 5 to the starting position by a controlled movement after it has supplied the thread 10 to the region of the traversing main thread guide 22, a stationary stop 48 is disposed on support 40 in the example shown. Moreover, the thread guide 5 is loaded by a spring 54 which holds the thread guide 5 in abutment with stop 48 and returns it to this position of abutment. In the embodiment shown, a torsion spring is used as the spring 54 having one end 55 anchored on a pin 49 which, in turn, is non-rotatably held by the support and another end 56 anchored in the thread guide 5.

The thread guide 5 comprises a short second arm 57 which cooperates with the stop 48. The stop 48 consequently acts as a path limiting means for the pivot movement of the thread guide 5.

Operation of the device described above will now be described in more detail with the aid of FIGS. 1 to 3.

On termination of build-up of a bobbin, the thread 10 running to the full bobbin tube 2 is suitably severed, e.g. by breaking it off, and guided to the pneumatic thread holding device 30, where the thread subsequently delivered from the thread delivery point 1 is continuously conducted away. This introduction of the thread into the thread holding device 30 can be carried out with uninterrupted delivery of the thread 10 or after taking up delivery after interrupting delivery. In the open-end spinning machine, bobbin change-over is consequently carried out with a continuous spinning process or with interruption of the spinning process. After the empty bobbin tube 2 has been inserted between the bobbin holding arms 21, the thread section 10' extending from the take-off rollers 11, 12 to the thread holding device 30 is picked up and placed on the shoulders of the auxiliary thread guide 4 forming the deflecting guides 41 and 42. Pickup may be with any suitable tool such as a hook. The thread 10 coming from the take-off rollers 11, 12 is extracted from the thread holding device 30 via the auxiliary thread guide 4. In case the suction force should not be sufficient, a second pair of thread take-off rollers may also be provided in the thread path between the auxiliary thread guide 4 and the pneumatic thread holding device 30, according to German Auslegeschrift No. 2 616 965.

On insertion of the thread 10 in the auxiliary thread guide 4, the thread section coming from the take-off rollers 11, 12 passes into the slot 52 in the thread guide 5 due to the guiding action of prong 50. The thread section extending to the thread holding device 30 is located between auxiliary thread guide 4 and section 47 of arm 44 above the blade 46. The bobbin tube 2 is now brought into contact with its drive shaft 20 and driven by lowering the bobbin holding arm 21. The thread catching projection 25 rotates with the bobbin tube 2 and catches the thread 10 stretched between the deflecting guides 41 and 42 and held parallel to the surface of the bobbin tube 2. By this means the thread 10 jumps down off the shoulder of deflecting guides 41 and 42. Section 47 of the arm 44 insures that thread 10 does not jump over the arm 44, but passes into the region of the blade 46. Due to the thread tension, thread 10 is severed by means of the blade 46. The other thread section extending to the thread take-off rollers 11, 12 is now wound on the bobbin tube 2, wherein the slot 52 determines the axial position of these reserve windings in relation to the bobbin tube 2. When the reserve winding is large enough, the thread guide 5 is pivoted by actuating member 53 until the arm 57 abuts stop 48 in the direction of the tube center, i.e. in the direction of the traversing main thread guide 22. The thread 10 is picked up by the main thread guide 22 and drawn out of the thread guide 5. The thread guide 5 is now released, returning under the action of the spring 54 to the basic position abutting stop 48.

It is also possible to arrange the thread delivery point 1 at the top and the bobbin tube 2 at the bottom, so that the auxiliary thread guide 4 and thread guide 5 are then also provided in reverse arrangement. The thread guide 5 does not have to be pivotably disposed on the support 40, but may slide in a guide in the direction of the tube center. Return of the thread guide to the basic position is preferably carried out by means of a tension spring. It is also quite possible to mount the thread guide 5 movably directly on the machine frame 13 in the vicinity of and separate from the auxiliary thread guide 4 between the latter and the take-off rollers 11, 12.

In order to form the reserve winding as far as possible to the end of the bobbin and as close as possible to the thread catching projection 25, the auxiliary thread guide 4 tapers at 400 on a side facing the main thread guide 22 at an end opposite the deflecting guides 41 and 42. In the region of taper 400 is located the slot 52 in the movable thread guide 5.

The blade 46 includes a longitudinal slot 460 in which extends the fastening screw and nut 461 for attachment and a guide pin 462. The longitudinal slot 460 is so large that the blade 46 can be adjusted parallel to its cutting edge 463. Since as a rule the thread 10 always contacts at the same point of the cutting edge 463, a different point of the cutting edge 463 can be brought into the working zone by this longitudinal adjustment of the blade 46. By rotating the blade 46, further utilization of the blade is achieved.

The auxiliary thread guide 4 and also the thread guide 5 can each be constructed as a single article. Preferably, however, both consist of sheet metal which has acquired its shape by stamping and bending, wherein the deflecting guides 41 and 42 of auxiliary thread guide 4 are formed by shoulders in the sheet metal. Similarly, in the example shown the actuating member 53 is constructed as a sheet metal strip bent upon itself.

The thread holding device 30 is of course, shown as a pneumatic device, but instead of this a mechanical clamp which is cleaned manually, mechanically, or pneumatically is also conceivable.

In the embodiment of FIGS. 1 to 3, the reserve winding is formed from thread 10 delivered from the thread delivery point 1. In FIG. 4 an example is shown in which the reserve winding is formed from the thread 10 extending from an auxiliary thread guide 6 to the thread holding device 30, wherein the thread length needed is taken off from the thread holding device 30. For this purpose, there is provided a thread guide 7 in the thread path between auxiliary thread guide 6 and thread holding device 30 by which the thread section extending to the thread holding device 30 can be pivoted into the region of the traversing thread guide 22. The auxiliary thread guide 6 and the thread guide 7 take the place of auxiliary thread guide 4 and thread guide 5 of FIG. 1.

The auxiliary thread guide 6 includes an approach ramp 60 disposed in the thread path in which extends from deflecting guides 41 and 42 on the side facing towards the thread holding device 30. Approach ramp 60 extends beyond the prong 71 of the forked end of the movable thread guide 7 facing towards the thread holding device 30. Prong 71 has a length such that in any position of its pivoting or sliding movement it extends sufficiently far beyond the upper end 61 of the auxiliary thread guide 6 to place the thread 10 reliably in front of the traversing main thread guide 22. The prong 70 of the forked end of the thread guide 7 facing away from the thread holding device 30 terminates beneath the approach ramp 60.

After bobbin change-over, thread 10 is positioned by the take-off rollers 11, 12 via the auxiliary thread guide 6 in or on the deflecting guides 41 and 42. The thread extends to the thread holding device 30 slightly above a slot 72 between the two prongs 70 and 71.

The bobbin tube 2 is now brought into contact with its drive shaft 20 and driven by lowering the bobbin holding arm 21. The thread catching projection 25 rotates with the bobbin tube 2 and catches the thread 10 stretched between the deflecting guides 41 and 42 and held parallel to the surface of the bobbin tube 2. By this means the thread 10 jumps down off the shoulder of deflecting guides 41 and 42.

As the bobbin is rotated by drive shaft 20, the thread is wound onto bobbin 2. Thread is thereby tensioned so that it is drawn across the path of the main thread guide 22 carried by traversing rod 23. This main thread guide 22 is a conventional self-threading guide so that thread will be picked up during the traversing motion of the thread guide.

The thread 10 extending from the bobbin 2 to the thread holding device slides down apparach ramp 60 and into slot 72 of the thread guide 7. This thread section thus is arranged outside the path of the traversing main thread guide 22. In the region of the bobbin 2 the thread is held in position by prong 71.

The thread 10 extending from the auxiliary thread guide 6 to the thread holding device 30 meanwhile forms the reserve winding. When the desired number of reserve wandanes is reached, the thread guide 7 is pivoted or moved in the direction of the traversing thread guide 22, whereby prong 71 displaces the thread 10 up approach ramp 60 and beyond the upper end 61 of the auxiliary thread guide 6, until the thread 10 passes into the region of the traversing thread guide 22 whereupon it is covered by the main windings formed and laid by guide 22.

Covering of thread is performed due to the fact that the thread, the end of which is pivoted towards the center of the tube extends to this tube 2 and thus lies in an inclined position to the latter so that the thread will be wound on the tube in such an inclined manner in the region of the main thread winding which will be laid on at a later time by the traversing thread guide 22.

Preferably, at the end of the slot 72, as shown in FIG. 4, an exchangeable blade 46 is disposed so that thread 10 comes to lie against the blade 46 and is severed after release by the approach ramp 60 and the upper end 61 of the auxiliary thread guide 6.

Cutting of thread occurs only after pivoting of the thread guide 7 as this thread cannot reach the blade 46 at an earlier moment. Cutting of the thread in connection with the tilting of the thread guide 7 prevents interference between the thread end and the thread forming normal windings.

In order that the reserve windings do not reach too far to the end of the bobbin tube 2 and hence need much space during their formation, a stationary thread guide 62 is carried on auxiliary thread guide 6 adjacent the deflecting guide 42 which faces towards the thread holding device 30 in the region of the approach ramp 60. The thread section 10 extends from the shoulder-like deflecting guides 41 and 42 of the auxiliary thread guide 6, between thread guide 62 and approach ramp 60, then beyond the approach ramp 60 over the slot 72 between the prongs 70 and 71 of the movable thread guide 7 to the thread holding device 30.

Variations of the subject of the invention described in connection with the example of FIGS. 1 to 3, are also possible with the example shown in FIG. 4.

If the movable thread guide 5 or 7 is not loaded by spring 54, the thread guide 5 or 7 must be returned to the starting position by hand or other controlled manner after it has placed the thread in front of the traversing thread guide 22. A stop 48, while not required, is appropriate to avoid erroneous adjustment of the thread guide 5 or 7. With the pivotable design of thread guide 5 or 7, the second arm 57 acting as path limiting means can likewise be omitted, but this path limiting means is advantageous for fixing the thread release position which insures optimum conditions for effecting transfer of the thread 10 to the traversing thread guide 22.

As FIG. 4 shows, movement of the thread guide 5 or 7 can also be carried out by acting on the thread guide 5 or 7 itself.

Severing can be carried out by the device or person actuating the thread guide 5 or 7. A bobbin changeover device which controls the whole process from insertion of the thread 10 in the auxiliary thread guide 4 or 6 to completion of the reserve winding by moving the thread guide 5 or 7, may incorporate and provide the severing function.

The auxiliary thread guide 4 or 6 and the movable thread guide 5 or 7 may also be disposed on a mobile maintenance apparatus, e.g. an automatic bobbin changeover device. Furthermore, the auxiliary thread guide 4 or 6 may be mounted stationarily at each spinning station, while the movable thread guide 5 or 7 is disposed on the mobile maintenance apparatus, e.g. a bobbin change-over device. In this case, the thread can for example, be inserted manually in the auxiliary thread guide 4 or 6, while lowering of the bobbin tube 2 is carried out by means of the bobbin holding arm 21 and sliding or pivoting of the movable thread guide 5 or 7 is carried out automatically from the maintenance apparatus.

While a preferred embodiment of the invention has been described using specific terms, such description is for illustrative purposes only, and it is to be understood that changes and variations may be made without departing from the spirit or scope of the following claims.

What is claimed is:

1. Apparatus for use with textile machinery for forming a reserve winding on a bobbin tube in a region outside a traversing path of a main thread guide which moves to and fro adjacent a length of the bobbin tube wherein the apparatus is of the type which includes a thread holding device disposed in the vicinity of a thread path defined between a thread delivery point and the bobbin tube, an auxiliary thread guide disposed between the bobbin tube and thread holding device having two deflecting guides between which the thread can be guided parallel to the surface of the bobbin tube, and a thread catching projection disposed on the bobbin tube for projecting between the two deflecting guides and oriented in the direction of rotation of the bobbin tube, wherein the improvement comprisis:

a support carried adjacent said bobbin tube;

said auxilairy thread guide being rigidly connected to said support;

a movable thread guide carried adjacent said auxiliary guide on a side opposite said bobbin tube;

a fork-like free end carried on said movable thread guide facing towards said deflecting guides of said auxiliary thread guide; and said fork-like free end being movable to move the thread section engaged thereby into the region of said traversing main thread guide.

2. The apparatus of claim 1 wherein said movable thread guide is loaded by a spring which holds the thread guide in a starting position in abutment with a stationary stop in the region of the reserve winding.

3. The apparatus of claim 2 wherein said movable thread guide is carried pivotably and comprises a second arm which abuts said stop during pivotal motion to limit the path for pivotal movement of said thread guide.

4. The apparatus of claim 1 wherein said movable thread guide includes an actuating member extenting generally perpendicular to the plane of movement of said movable thread guide on a side thereof opposite said main thread guide.

5. The apparatus of claim 1 wherein said deflecting guides include two shoulders carried on said auxiliary thread guide and a slot separating said two shoulders facing towards the bobbin tube.

6. The apparatus of claim 1 wherein the support of said auxiliary thread guide carries said movable thread guide.

7. The apparatus of claim 6 wherein a side of said auxiliary thread guide facing towards the main thread guide includes a tapered region at an end facing away from the deflecting guides, and a slot formed in the fork-like end of the movable thread guide is located in the region of said taper.

8. The apparatus of claim 1 wherein said auxiliary thread guide includes an arm arranged between said deflecting guides and said thread holding device, said arm extending in the direction of said bobbin tube and having a groove in which is disposed an exchangeable blade.

9. The apparatus of claim 8 wherein said arm is angled and comprises a section running essentially parallel to said auxiliary thread guide which extends to beyond said deflecting guides.

10. The apparatus of claim 1 wherein said auxiliary thread guide includes an approach ramp disposed between said deflecting guides and said thread holding device, said fork-like end of said movable thread guide having a first prong facing towards said thread holding device which extends beyond said approach ramp and a second prong facing away from the thread holding device which ends below said approach ramp.

11. The apparatus of claim 10 including a stationary thread guide disposed adjacent said deflecting guides facing towards said thread holding device in the region of said approach ramp.

12. The apparatus of claim 10 including an exchangeable blade carried between said two prongs of said fork-like end of said movable thread guide.

13. The apparatus of claim 12 wherein said blade is carried for adjustment parallel to its cutting edge.

14. The apparatus of claim 1 wherein said auxiliary thread guide is constructed as a bent, stamped sheet metal part and said deflecting guides are formed by shoulders in the sheet metal.

* * * * *